United States Patent [19]

Cubides

[11] Patent Number: 4,878,266

[45] Date of Patent: Nov. 7, 1989

[54] EASEL HINGE

[75] Inventor: Wilson J. Cubides, Somerset, N.J.

[73] Assignee: Art Materials Service, Inc., N.J.

[21] Appl. No.: 333,176

[22] Filed: Apr. 4, 1989

[51] Int. Cl.[4] ..... E05D 1/02

[52] U.S. Cl. ..... 16/225; 16/226; 16/DIG. 13; 40/152.1

[58] Field of Search ..... 16/225, 226, 374, 375, 16/DIG. 13; 40/152.1, 606, 607

[56] References Cited

U.S. PATENT DOCUMENTS

| | | | |
|---|---|---|---|
| 3,021,631 | 2/1962 | Cross | 40/152.1 |
| 3,516,115 | 6/1970 | Koleske | 16/225 |
| 4,366,636 | 1/1983 | Hearsh | 40/152.1 |

FOREIGN PATENT DOCUMENTS

| | | | |
|---|---|---|---|
| 835010 | 2/1970 | Canada | 16/DIG. 13 |
| 2842159 | 4/1980 | Fed. Rep. of Germany | 16/DIG. 13 |
| 1487999 | 10/1977 | United Kingdom | 16/DIG. 13 |

*Primary Examiner*—Nicholas P. Godici
*Assistant Examiner*—James R. Miner
*Attorney, Agent, or Firm*—Arthur L. Lessler

[57] ABSTRACT

An easel hinge made of a sheet of material having an outer portion with two leg sections joined by a hinge support section. A central portion of the sheet is disposed between the leg sections and interconnected with the hinge support section by bendable hinge elements. Two straddle elements are provided, with each straddle element being spaced from the hinge support section and interconnecting a corresponding leg section with the central portion of the sheet. The sheet includes mounting holes for securing the outer portion of the sheet to one panel of an easel, and the central portion of the sheet to the other panel of the easel, so that the straddle elements limit the angular movement of the easel panels relative to each other.

8 Claims, 4 Drawing Sheets

EASEL HINGE

BACKGROUND OF THE INVENTION

This invention relates to an easel hinge, and more particularly a hinge for an easel consisting of two panels angularly movable relative to each other, which hinge is capable of being manufactured separately from the panels themselves and from a unitary sheet of material.

An easel hinge should permit angular movement of the panels relative to each other, while limiting the extent of the angular movement so that the easel does not fall down as a result of increase in the angle between the panels due, for example, to the bottom edges of the panels sliding on the surface supporting the easel.

Various types of easel hinges are known in the art, and are exemplified by the following U.S. Patents:

U.S. Pat. No. 2,456,720 to Miles;
U.S. Pat. No. 2,926,441 to Cross;
U.S. Pat. No. 3,021,631 to Cross;
U.S. Pat. No. 3,226,863 to Southard;
U.S. Pat. No. 3,275,281 to Sampson; and
U.S. Pat. No. 4,366,636 to Hearsh.

Except for the hinge of Hearsh, the aforementioned hinges use various types of latching or interlocking arrangements to limit angular movement of the easel panels relative to each other. These arrangements generally require a relatively complex construction and do not ensure that the easel panels will not come further apart if some additional force is applied.

The hinge of Hearsh provides a two-piece brace comprising tongues 61 and 63 which are glued together to limit angular movement of the panels relative to each other. This hinge thus has a relatively complex construction and does not have the capability of providing a hinge which can be used with various types of easel panels, since the brace is operatively associated with the panels.

Accordingly, an object of the invention is to provide an improved easel hinge which can be manufactured at low cost and used with a variety of easel panels.

SUMMARY OF THE INVENTION

As herein described, there is provided an easel hinge made of a sheet of material having a first portion with at least one leg section amd a hinge support section. The sheet also has a second portion adjacent the leg section and interconnected with the hinge support section by at least one bendable hinge element. At least one straddle element spaced from the hinge support section interconnects the leg section with the second portion. The sheet includes first attachment means adapted to enable the first portion to be secured to one panel of an easel, and second attachment means adapted to enable the second portion to be secured to another panel of the easel. With this arrangement the easel panels may be angularly moved relative to each other to cause bending of the hinge elements, while the straddle element limits the angular movement of the panels.

IN THE DRAWINGS

DETAILED DESCRIPTION

Figure 1:
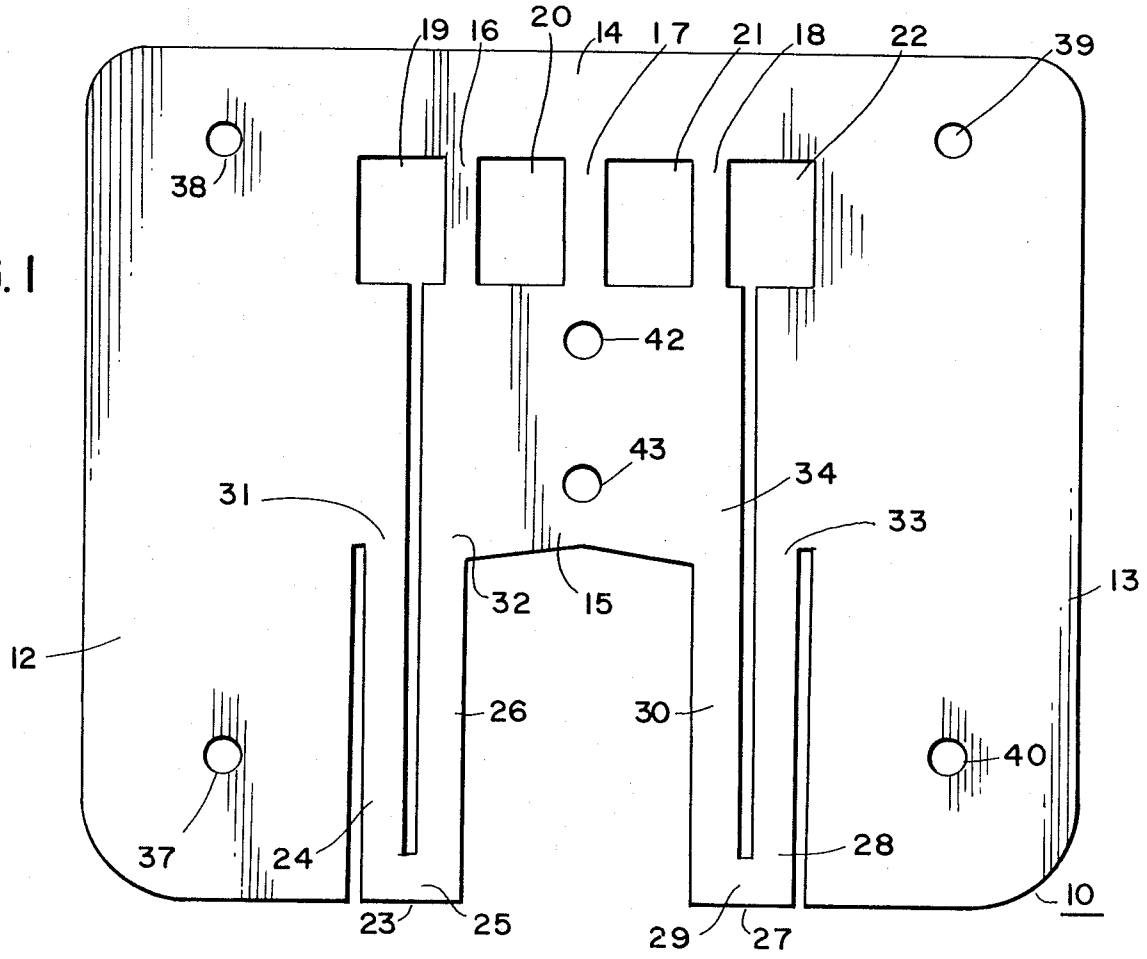
FIG. 1 is a plan view showing an easel hinge according to a first embodiment of the invention, after manufacture thereof and before the same is secured to a set of easel panels.
Figure 3:
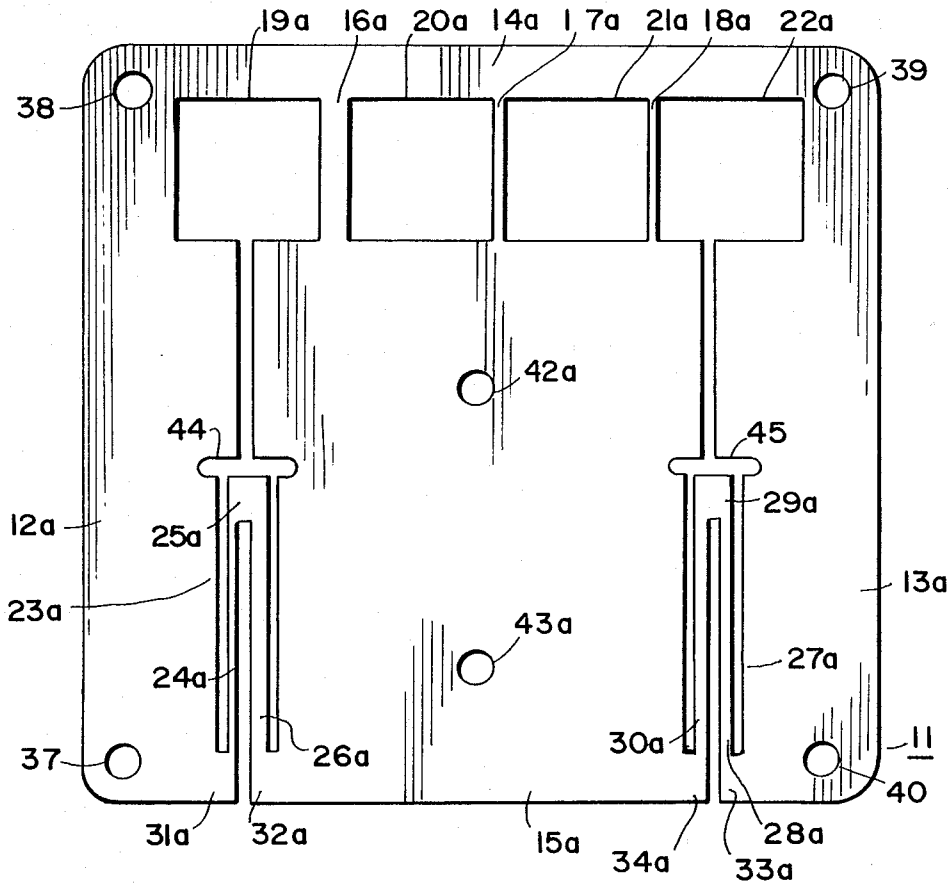
FIG. 3 is a plan view showing an easel hinge according to a second embodiment of the invention, after manufacture thereof and before the same is secured to a set of easel panels.

The hinges 10 and 11 shown in FIGS. 1 and 3 respectively are preferably stamped from a unitary sheet of material such as metal or plastic, metals such as steel, aluminum, copper and brass being preferred.

The hinge 10 has an inverted generally U-shaped outer portion comprising a first leg section 12, a second leg section 13, and a hinge support section 14 interconnecting the leg sections.

The hinge 10 also has a central portion 15 disposed between the leg sections 12 and 13. The upper end of the central portion 13 is interconnected with the hinge support section 14 by three substantially parallel hinge elements 16, 17 and 18, which are defined as a result of the provision of adjacent cutouts 19, 20, 21 and 22 in the sheet material.

The left side of the central portion 15 is interconnected with the adjacent first leg section 12 by a straddle element 23 in the form of a bendable strip having a first strip portion 24, a strip junction region 25, and a second strip portion 26.

In similar fashion the right side of the central portion 15 is interconnected with the adjacent second leg section 13 by a straddle element 27 in the form of a bendable strip having a first strip portion 28, a strip junction region 29, and a second strip portion 30.

The straddle element 23 connects the region 31 of the leg section 12 with the region 32 of the central portion 15; while the straddle element 27 connects the region 33 of the leg section 13 with the region 34 of the central portion 15. The regions 31 and 32 are substantially equidistant from the hinge support section 14; and the regions 33 and 34 are also substantially equidistant from the hinge support section 14.

Figure 2:
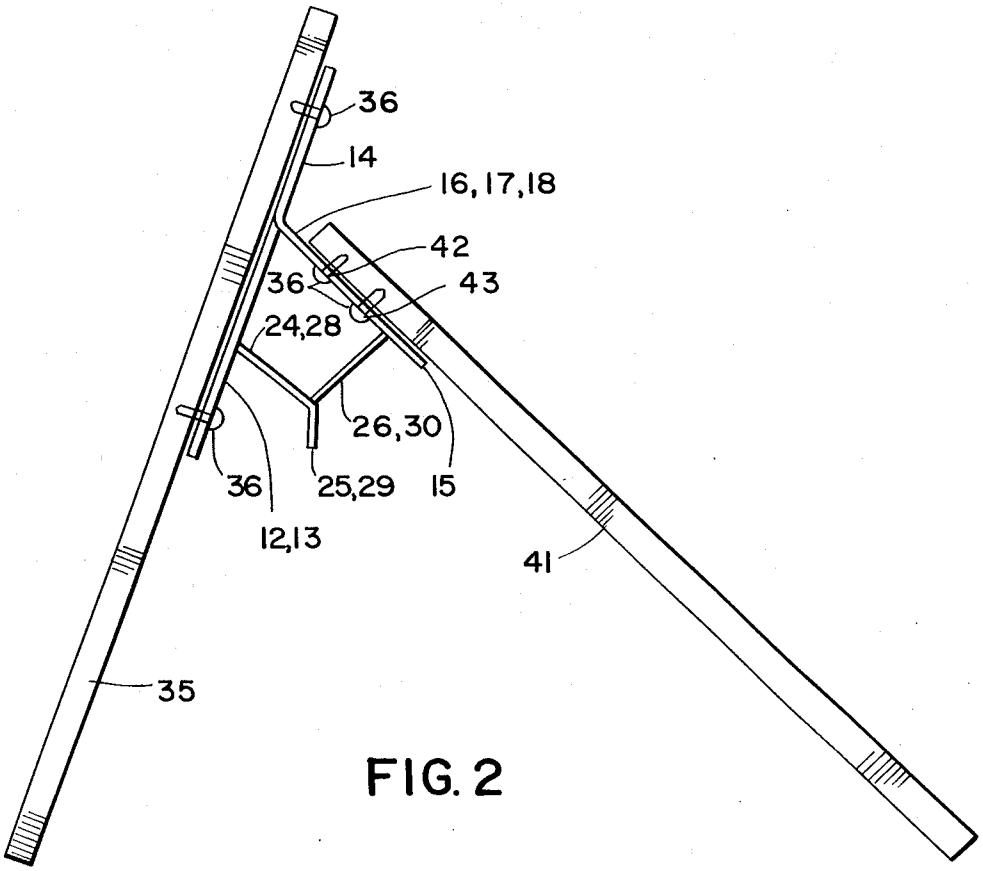
FIG. 2 is a side elevation view of an easel incorporating the hinge shown in FIG. 1.

As best seen in FIG. 2, the hinge 10 is used by securing the outer portion to the front panel 35 using bolts, screws, rivets or the like 36 inserted through mounting holes 37, 38, 39 and 40 of the outer portion; and securing the central portion 15 to the rear panel 41 using bolts, screws, rivets or the like 36 inserted through mounting holes 42 and 43 of the central portion 15. Alternatively, the hinge may be self-anchored by means such as manufacturing self-expanding projections extending from mounting holes 37, 38, 39 and 40.

When the easel panels 35 and 41 are angularly moved relative to each other, the hinge elements 16, 17 and 18 are caused to bend, while the straddle elements 23 (strips 24 and 26 and strip junction region 25) and 27 (strips 28 and 30 and strip junction region 29) limit the angular movement of the easel panels 35 and 41 relative to each other.

The hinge 11 shown in FIG. 3 has a similar configuration to the hinge 10; except that whereas in the hinge 10 the strip junction regions 25 and 29 of the straddle elements 23 and 27 are at the ends of the strip portions thereof furthest from the hinge support section 14, in the hinge 11 the strip junction regions **25*a* and 29*a* of the straddle elements 23*a* and 27*a* are at the ends of the strip portions thereof closest to the hinge support section 14***a*.

In order to facilitate the location of the strip junction regions 25*a* and 29*a*, the hinge 11 is provided with adjacent cutouts 44 and 45.

Figure 4:
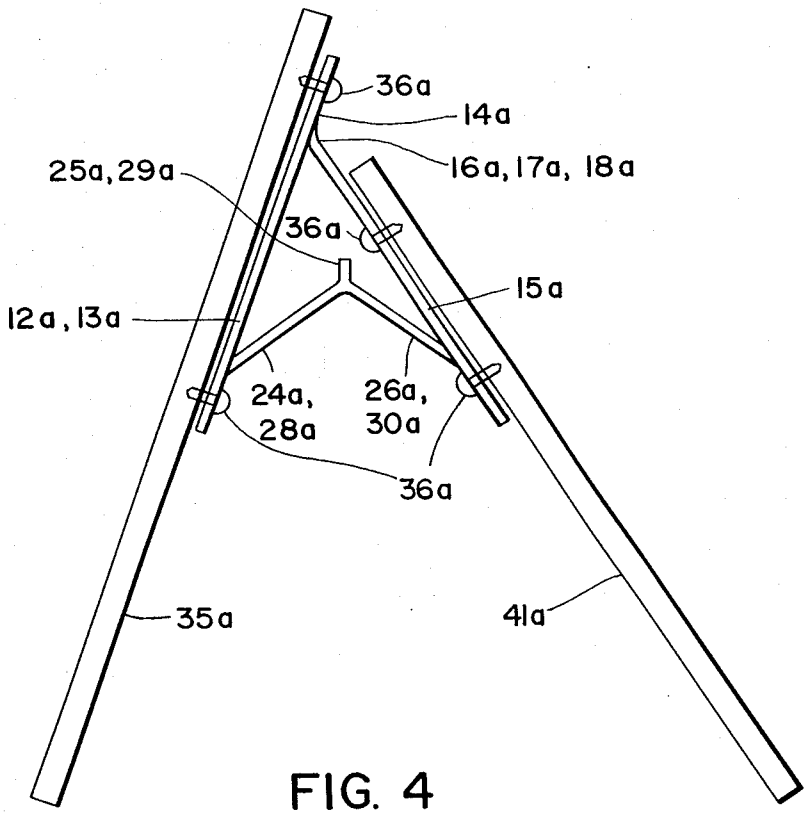
FIG. 4 is a side elevation view of an easel incorporating the hinge shown in FIG. 3.

As a result of the difference in positioning of the strip junction regions in the hinges 10 and 11, in the hinge 10 the straddle elements have a generally V-shaped configuration when the easel panels are positioned as shown in FIG. 2; while in the hinge 11 the straddle elements have an inverted generally V-shaped configuration when the easel panels are positioned as shown in FIG. 4.

Those elements shown in FIGS. 3 and 4 which correspond to elements shown in FIGS. 1 and 2 respectively have the same numerals followed by the letter "a".

I claim:

1. An easel hinge comprising a unitary sheet of material having:

an inverted generally U-shaped outer portion with first and second leg sections interconnected by a hinge support section;

a central portion disposed between said leg sections and interconnected with said hinge support section by a plurality of substantially parallel bendable hinge elements;

a first straddle element interconnecting said first leg section with a first adjacent side of said central portion;

a second straddle element interconnecting said second leg section with a second adjacent side of said central portion;

each of said straddle elements comprising a strip having a bendable portion extending between a region of the corresponding leg section and a region of the adjacent side of said central portion;

first attachment means adapted to enable said outer portion to be secured to one panel of an easel; and second attachment means adapted to enable said central portion to be secured to another panel of the easel, whereby said easel panels may be angularly moved relative to each other to cause bending of said hinge elements, said straddle elements limiting the angular movement of the panels.

2. The easel hinge according to claim 1, wherein the region of each leg section and the region of the adjacent side of said central portion to which the corresponding straddle element extends are spaced substantially equal distances away from said hinge support section.

3. The easel hinge according to claim 1, wherein said material is sheet metal.

4. The easel hinge according to claim 3, wherein said metal is aluminum, steel, copper or brass.

5. The easel hinge according to claim 2, wherein each straddle element comprises two strip portions interconnected by a strip junction region.

6. The easel hinge according to claim 1, wherein each straddle element has a generally V-shaped configuration after said hinge elements have been bent by angular movement of said central portion relative to said outer portion.

7. An easel hinge comprising a sheet of material having: a first portion with at least one leg section and a hinge support section;

a second portion adjacent said leg section and interconnected with said hinge support section by at least one bendable hinge element;

at least one straddle element spaced from said hinge element and interconnecting said leg section with said second portion;

first attachment means adapted to enable said first portion to be secured to one panel of an easel; and second attachment means adapted to enable said second portion to be secured to another panel of the easel, whereby said easel panels may be angularly moved relative to each other to cause bending of said hinge elements, said straddle element limiting the angular movement of the panels.

8. The easel hinge according to claim 7, wherein said straddle element comprises a strip having a bendable portion extending between a region of said leg section and a region of said central portion.

* * * * *